US005310319A

United States Patent [19]

Grant et al.

[11] Patent Number: 5,310,319

[45] Date of Patent: May 10, 1994

[54] FREE STANDING TURBINE DISK SIDEPLATE ASSEMBLY

[75] Inventors: Parker A. Grant, Rocky Hill; Stephen D. Hoyt, Glastonbury, both of Conn.

[73] Assignee: United Technologies Corporation, Hartford, Conn.

[21] Appl. No.: 3,337

[22] Filed: Jan. 12, 1993

[51] Int. Cl.[5] ..... F01D 5/30

[52] U.S. Cl. ..... 416/220 R; 416/95

[58] Field of Search ..... 416/95 R, 220 R, 204 RA; 415/115, 116

[56] References Cited

U.S. PATENT DOCUMENTS

| | | | |
|---|---|---|---|
| 2,928,650 | 3/1960 | Hooker et al. | 416/95 |
| 2,988,325 | 6/1961 | Dawson | 416/95 |
| 3,832,090 | 8/1974 | Matto | 415/115 |
| 4,247,257 | 1/1981 | Benoist et al. | 416/95 |
| 4,432,555 | 2/1984 | Langley | 416/95 |
| 4,435,123 | 3/1984 | Levine | 416/95 |
| 4,507,052 | 3/1985 | Thompson | 416/220 R |
| 4,558,988 | 12/1985 | Kisling et al. | 416/220 R |
| 4,701,105 | 10/1987 | Cantor et al. | 416/95 |
| 4,793,772 | 12/1988 | Zaehring et al. | 416/95 |
| 4,805,398 | 2/1989 | Jourdain et al. | 415/116 |
| 4,820,116 | 4/1989 | Hovan et al. | 415/115 |
| 4,822,244 | 4/1989 | Maier et al. | 416/95 |
| 4,854,821 | 8/1989 | Kernon et al. | 416/95 |
| 4,890,981 | 1/1990 | Corsmeier et al. | 416/220 R |
| 5,018,943 | 5/1991 | Corsmeier et al. | 416/220 R |
| 5,135,354 | 8/1992 | Novotny | 415/115 |
| 5,143,512 | 9/1992 | Corsmeier et al. | 415/115 |
| 5,173,024 | 12/1992 | Mouchel et al. | 416/220 R |

*Primary Examiner*—John T. Kwon

[57] ABSTRACT

A gas turbine engine having a turbine rotor assembly with a free standing sideplate assembly is disclosed. Various construction details are developed which provide a sideplate assembly which is not radially or axially supported by the web or rim of the adjacent disk. In one particular embodiment, a rotor assembly includes a rotor disk, having a rim, a web, and a bore, and a sideplate assembly, having a web and a bore. The web of the sideplate is radially supported by the bore of the sideplate and includes a disk seal and an aperture. The disk seal is engaged with the rotor disk and has an axially directed seal force provided by an axially interfering fit between the sideplate and rotor disk. The aperture provides fluid communication between a source of cooling fluid and the rotor disk.

20 Claims, 3 Drawing Sheets

FREE STANDING TURBINE DISK SIDEPLATE ASSEMBLY

TECHNICAL FIELD

This invention relates to gas turbine engines, and more particularly to turbine disk sideplate assemblies.

BACKGROUND OF THE INVENTION

A typical gas turbine engine has an annular axially extending flow path for conducting working fluid sequentially through a compressor section, a combustion section, and a turbine section. The compressor section includes a plurality of rotating blades which add energy to the working fluid. The working fluid exits the compressor section and enters the combustion section. Fuel is mixed with the compressed working fluid and the mixture is combusted to thereby add more energy to the working fluid. The resulting products of combustion are then expanded through the turbine section. The turbine section includes a plurality of rotating blades which extract energy from the expanding fluid. A portion of this extracted energy is transferred back to the compressor section via a rotor shaft interconnecting the compressor section and turbine section. The remainder of the energy extracted may be used for other functions.

The rotor assembly of the gas turbine engine includes a rotating disk to which the rotor blades are attached. In addition to the rotor blades, the disk may provide support for other rotating structure such as seal runners and sideplates. The size and weight of the disk is dependant upon the loads required to be supported by the disk. The rotational forces inherent to the rotating disk magnify the loads many times. The size and weight of the rotor assembly directly affects the output of the gas turbine engine, with additional weight or inertia lowering the operating efficiency of the gas turbine engine.

Much research and development has gone into reducing the loads on turbine disks to thereby minimize the size of the turbine disk. Turbine structural components have been designed to be lighter by using higher strength and lower density materials. In addition, the rotor assembly and associated components have been configured to reduce the size at the turbine disks.

Sideplate assemblies have also been a source of research and development. A typical sideplate assembly performs several functions. An example is disclosed in U.S. Pat. No. 4,701,105, issued to Cantor et al and entitled "Anti-Rotation Feature for a Turbine Rotor Faceplate". First, the sideplate shields the disk from direct contact with hot working fluid. Second, the sideplate provides passages for a flow of cooling fluid along the forward face of the disk and into the rotor blade. The sideplate functions to protect the disk directly, and the rotor blade indirectly, from the adverse effects of heat transferred from the hot working fluid. The sideplate assembly, however, adds to the loading of the disk and therefore requires the disk to be larger to support the sideplate assembly.

The above art notwithstanding, scientists and engineers under the direction of Applicants' Assignee are working to develop lightweight turbine rotor assemblies to maximize the operating efficiency of gas turbine engines.

DISCLOSURE OF THE INVENTION

According to the present invention, a rotor assembly includes a sideplate assembly and a disk having a bore, web, and rim, wherein the sideplate assembly is not radially retained by either the web or rim of the disk.

According further to the present invention, the sideplate assembly includes a sideplate in axially interfering engagement with the disk and a disk seal disposed between the sideplate and disk having an axially directed seal force produced by the interfering engagement.

According to a specific embodiment of the present invention, a rotor assembly includes a rotor disk having a disk self-sustaining radius located radially outward of the rotor disk bore and a sideplate assembly having a sideplate self-sustaining radius located radially outward of a sideplate bore. A radial and axial locating means is disposed between a sideplate bore and the rotor disk bore. The sideplate includes an aperture adapted to permit fluid flow from a source of cooling fluid to a cavity between the sideplate and rotor disk. A seal means is disposed between the sideplate and rotor disk. The seal means is effectuated by a seal force produced by an axially interfering fit between the radially outer end of the sideplate and rotor disk.

"Self-sustaining radius", as used herein, is defined as the radius of a rotating body at which the material of the body will be stressed to its allowable stress when rotating at a given speed and temperature. Material beyond this radius will not sustain itself. The location of the self-sustaining radius for a given body may be calculated form well known stress equations taking into consideration material characteristics, body geometrical features, speed and temperature.

"Free-standing" disk, as used herein, is defined as a disk having sufficient bore material to sustain the bore, web and rim of the disk when subjected to rotational forces. As a result, a free-standing disk requires no additional means of radial support to sustain the disk when subjected to rotational forces.

A principal feature of the present invention is the free standing sideplate disk having no locating means attached to the web or rim of the rotor disk. Another feature of the present invention is the disk seal means having a seal force generated by an axially interfering fit between the sideplate and the rotor disk. A feature of the specific embodiment is the aperture disposed between the source of cooling fluid and the cavity between the sideplate and rotor disk.

A primary advantage of the present invention is the minimal size and weight of the rotor assembly as a result of the free standing sideplate. Removing the radial loading of the sideplate from the rotor disk web and rim eliminates the need for a larger rotor disk to support the radial load. The sideplate of the invention has a web and bore, with the sideplate bore supplying the principal rotational load carrying means for the sideplate. Another advantage of the present invention is the prevention of direct contact between the rotor disk and hot working fluid as a result of the disk seal means. The seal is effectuated by an axially directed seal force as a result of the interfering fit between the sideplate and rotor disk. The interfering fit results from the locating means positioning the sideplate such that the radially outer end engages the rotor disk. An advantage of the specific embodiment is the cooling of the rotor disk as a result of cooling fluid flowing through the aperture and into the cavity between the sideplate and disk. The cooling fluid cools the disk web and then flows radially outward to provide cooling to other rotor assembly structure, such as the rotor blades.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
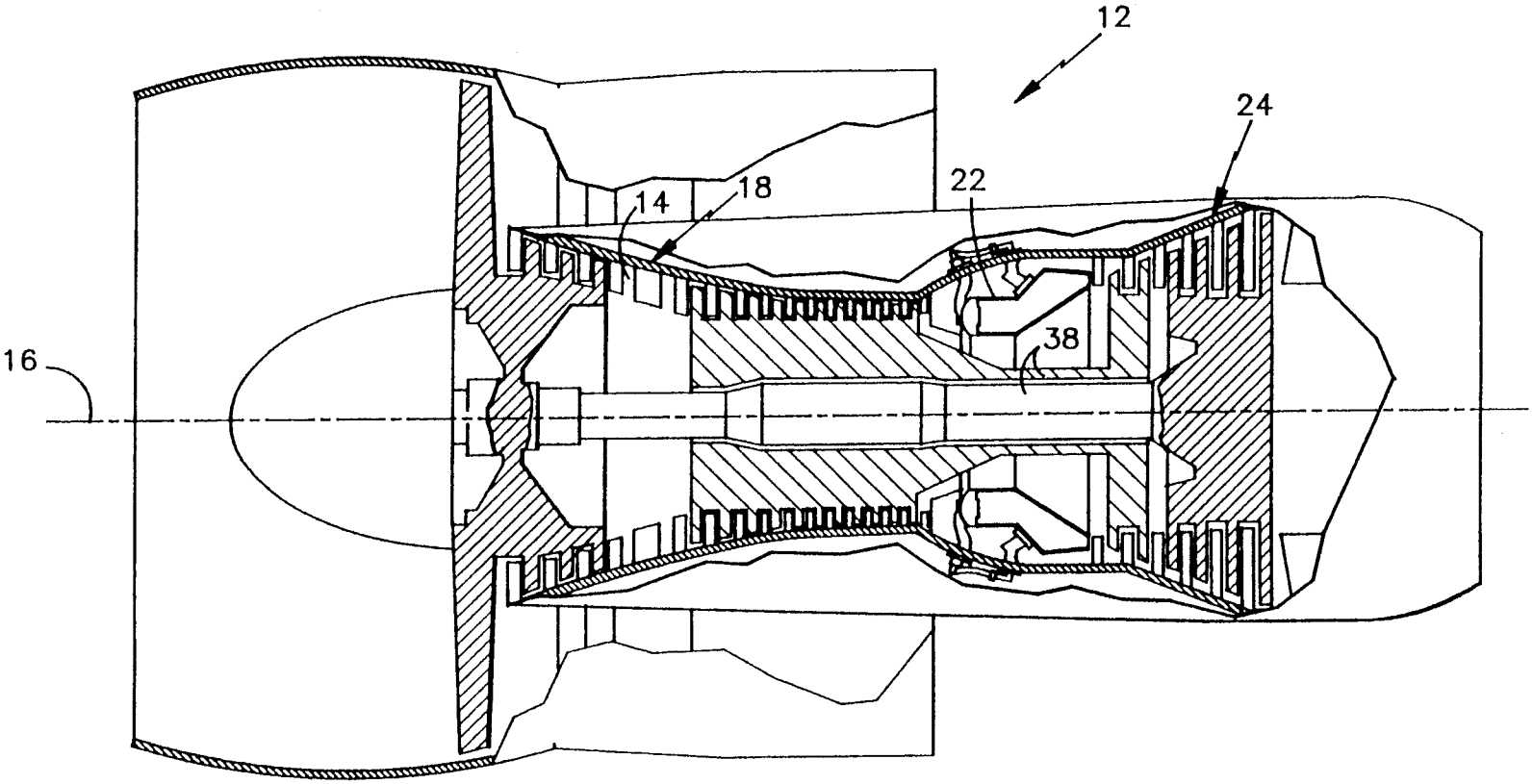
FIG. 1 is a sectional side view of a gas turbine engine.

FIG. 1 is an illustration of a gas turbine engine 12 shown as a representation of a typical turbomachine. The gas turbine engine includes a working fluid flow path 14 disposed about a longitudinal axis 16, a compressor section 18, a combustion section 22, and a turbine section 24.

Figure 2:
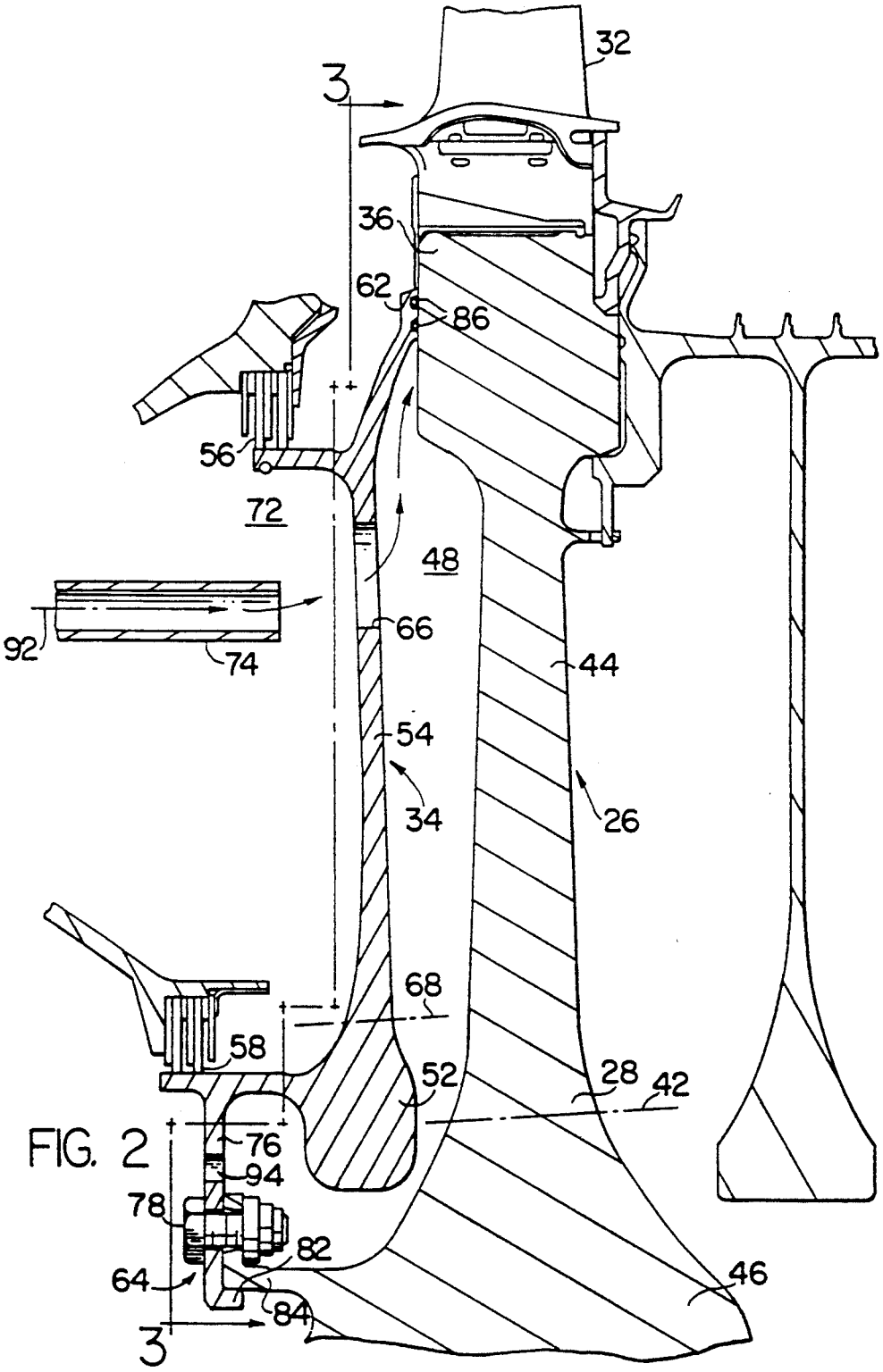
FIG. 2 is a cross-sectional side view of a rotor assembly having a free standing sideplate assembly.

Referring to FIG. 2, a turbine rotor assembly 26 for the gas turbine engine includes an annular rotor disk 28 having a plurality of rotor blades 32 attached thereto and a sideplate assembly 34 disposed axially forward of the rotor disk. The rotor blades are attached to the rim 36 of the rotor disk and extend through the flowpath of the gas turbine engine (see FIG. 1). The disk is attached at its radially inner end to a rotor shaft 38 interconnecting the turbine section and compressor section of the gas turbine engine. The rotor disk includes a self-sustaining radius 42, a web 44 disposed radially outward of the self-sustaining radius and radially inward of the rim, and a bore 46 disposed radially inward of the self-sustaining radius.

The sideplate assembly is disposed axially forward of the rotor disk and defines a disk cavity 48 therebetween. The sideplate assembly includes a bore 52, a web 54, a first seal means 56, a second seal means 58, a disk cavity seal means 62, locating means 64, and a plurality of cooling apertures 66. The sideplate assembly has a self-sustaining radius 68 which defines the separation between the bore portion and the web of the sideplate assembly. The first and second seal means define a cooling fluid cavity 72 disposed axially upstream of the sideplate assembly. Within the cooling fluid cavity is a tangential on-board injector (TOBI) 74 for injecting cooling fluid into the disk cavity. This cooling fluid is drawn from the compressor section and bypasses the combustion section. The cooling fluid exits the TOBI and passes through the apertures into the disk cavity to cool the web of the disk.

Figure 5:
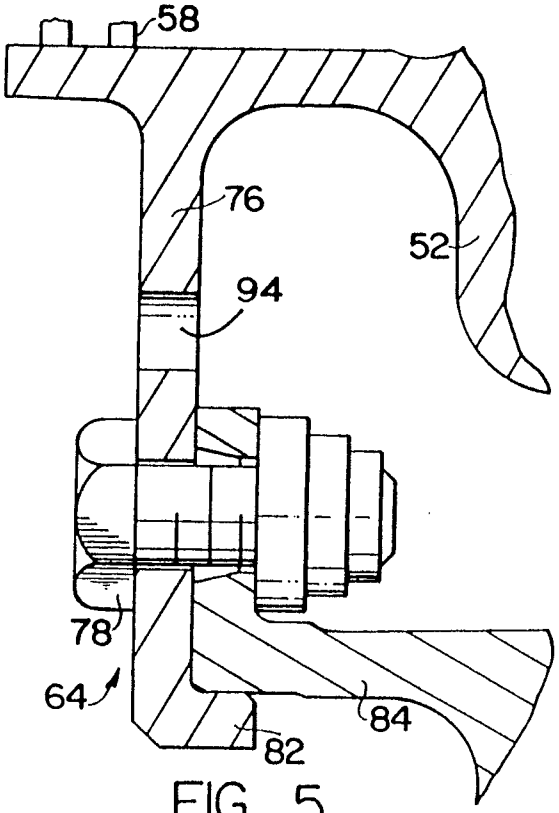
FIG. 5 is a cross-sectional view of axial and radial locating means of the sideplate assembly.

The locating means is disposed on the bore of the sideplate and provides means to radially and axially locate the sideplate assembly relative to the rotor disk. The locating means also rotationally secures the sideplate relative to the disk. The locating means is disposed radially inwardly of the self-sustaining radius of the sideplate and the self-sustaining radius of the rotor disk. The locating means, as shown in FIG. 5, includes a flange 76 extending radially inward from the second seal means, a mechanical fastener 78, and a radial lip 82. The mechanical fastener engages the flange with an extension 84 of the rotor disk bore to provide axial positioning and rotational securing of the sideplate assembly to the rotor disk. The lip engages the radially inward surface of the extension of the rotor disk to provide radial positioning of the sideplate assembly.

Figure 4:
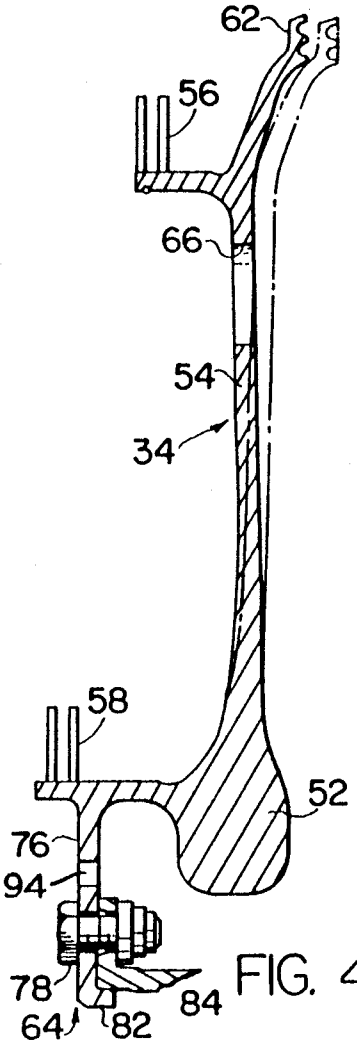
FIG. 4 is a cross-sectional side view of the sideplate assembly with dashed lines indicating the non-installed shape of the sideplate assembly.
Figure 3:
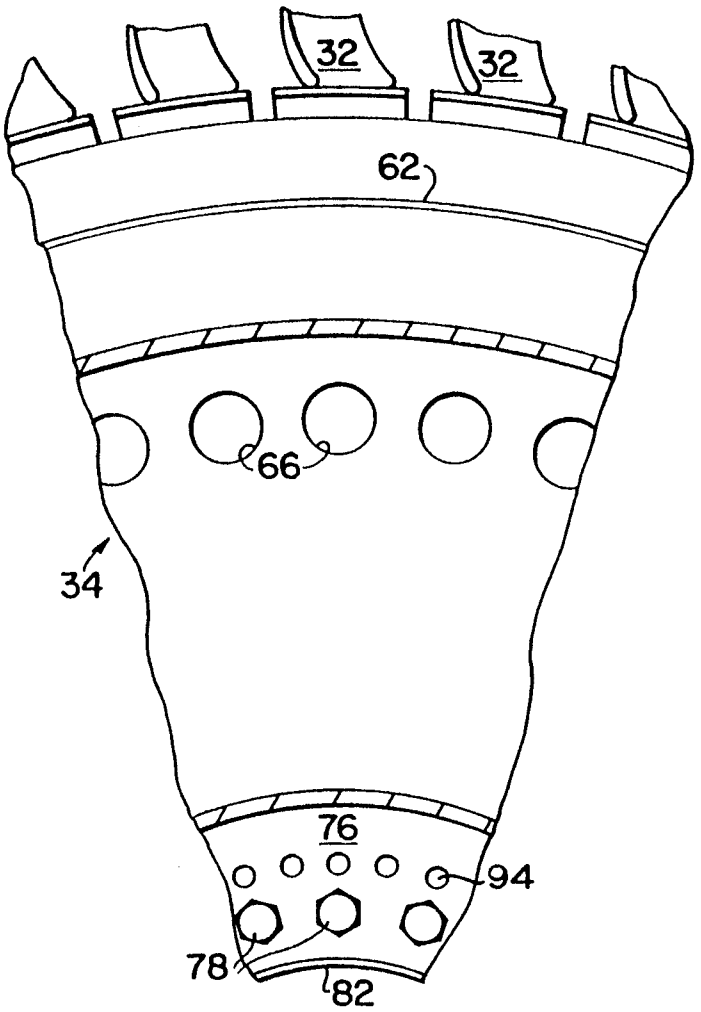
FIG. 3 is an axial view of a portion of the sideplate assembly with the brush seals cut away.

Referring to FIG. 2, the disk cavity seal means includes a pair of wire seals 86 disposed axially between the radially outer end of the sideplate and the rim of the disk. Seal force for the wire seal is provided by the reaction force of the sideplate to the axial positioning provided by the locating means. The reaction force causes a deflection of the sideplate in an installed condition. As shown in FIG. 4, the sideplate assembly has a relaxed position, as indicated by the dash-lines, and an installed condition in which the web of the sideplate assembly is deflected axially forward causing a sealing force in the axial direction. This sealing force presses the sideplate assembly against the rotor disk and compresses the wire seals to produce a seal around the periphery of the sideplate and rotor disk engagement.

During operation, rotational forces are directed radially outwardly for the portion of the bulk material of a rotating structure that is radially outward of the self-sustaining radius. For the rotor disk, the rotor blade assemblies rim, and web cause a significant radial load on the rotor disk which is carried by the bore of the rotor disk. For the sideplate assembly, the web, first seal means, and disk cavity seal means cause radial loads which are reacted by the sideplate bore such that the sideplate assembly is free-standing. By removing the sideplate assembly loading from the web of the rotor disk, the rotor disk is significantly smaller and lighter than prior art rotor disks. The increase in size of the sideplate assembly is nominal relative to the reduction in size of the rotor disk resulting from removal of the sideplate from the disk.

Cooling fluid flows out of the TOBI and into the seal cavity. As shown in FIG. 2, the apertures are not radially aligned with the centerline of the exit of the TOBI and, in fact, are radially outward of the TOBI centerline 92. This radial misalignment takes into account the disk pumping action caused by the rotational forces on the boundary layer of the fluid along the surface of the sideplate web. This disk pumping effect urges fluid in the boundary layer to flow radially outwardly and therefore the apertures more effectively convey the cooling fluid into the disk cavity by being radially outward of the centerline of the TOBI.

Within the disk cavity the cooling fluid flows over the surfaces of the rotor disk to cool the rotor disk. A portion of this cooling fluid then passes radially outward into passages in the radially outer portion of the rotor disk and into the rotor blade for cooling this structure. The remainder of the cooling fluid within the disk cavity passes radially inward through the disk cavity and passes through a cooling hole 94 in the flange (see FIG. 5). This cooling fluid is then passed over other turbine section structure to provide cooling of other structure within the turbine section.

The locating means provides axial retention of the sideplate assembly to the rotor disk to secure the sideplate assembly in place and to cause the deflection of the web of the sideplate assembly which produces the seal force. In addition, the locating means provides radial positioning of the sideplate assembly. During rotation of the sideplate assembly, the principal load bearing structure of the sideplate assembly is the bore. In a non-operational condition, however, the locating means, through the mechanical fastener and the lip, provides the means for positioning and retaining the sideplate assembly to the disk.

Although the invention has been shown and described with respect with exemplary embodiments thereof, it should be understood by those skilled in the art that various changes, omissions, and additions may be made thereto, without departing from the spirit and scope of the invention.

What is claimed is:

1. A gas turbine engine having a longitudinal axis and an axially disposed flow path defining a passage for working fluid, the gas turbine engine including a rotor assembly having a rotor disk and sideplate assembly, the rotor disk having a rotor self-sustaining radius and including a rotor disk bore disposed radially within the rotor self-sustaining radius and a rotor web disposed radially outward of the rotor self-sustaining radius, the sideplate assembly being positioned axially adjacent to the rotor disk and defining a disk cavity therebetween, the sideplate assembly including a sideplate disk having a sideplate self-sustaining radius, a sideplate bore disposed radially within the sideplate self-sustaining radius, and a sideplate web disposed radially outward of the sideplate self-sustaining radius, locating means disposed on the sideplate bore and engaged with the rotor disk bore, the sideplate blocking the passage of working fluid into the disk cavity such that engagement between working fluid and the rotor web is blocked, and wherein the sideplate assembly is not axially or radially supported by the disk web.

2. The gas turbine engine according to claim 1, further including a source of cooling fluid and wherein the sideplate disk further includes an aperture adapted to permit fluid communication between the source of cooling fluid and the cavity.

3. The gas turbine engine according to claim 2, wherein the source of cooling fluid is a tangential onboard injector having an injection axis, wherein the aperture includes an axially directed central axis, and wherein the injection axis and central axis are not radially aligned such that the central axis is radially outward of the injection axis.

4. The gas turbine engine according to claim 1, further including seal means, the seal means including a first rotating seal disposed on the sideplate bore and a second rotating seal disposed on the sideplate web, the first rotating seal and second rotating seal defining a second cavity, the second cavity in fluid communication with the source of cooling fluid and with the disk cavity.

5. The gas turbine engine according to claim 2, further including seal means, the seal means including a first rotating seal disposed on the sideplate bore and a second rotating seal disposed on the sideplate web, the first rotating seal and second rotating seal defining a second cavity, the second cavity in fluid communication with the source of cooling fluid and with the disk cavity.

6. The gas turbine engine according to claim 3, further including seal means, the seal means including a first rotating seal disposed on the sideplate bore and a second rotating seal disposed on the sideplate web, the first rotating seal and second rotating seal defining a second cavity, the second cavity in fluid communication with the source of cooling fluid and with the disk cavity.

7. The gas turbine engine according to claim 1, wherein the sideplate web includes third seal means engaged with the disk web, and wherein engagement of the locating means with the rotor disk bore axially locates the sideplate assembly such that the third seal means and the disk web are in axially interfering engagement, the interfering engagement urging the sideplate web away from the disk web to thereby produce a sealing force between the third seal means and the disk web.

8. The gas turbine engine according to claim 2, wherein the sideplate web includes third seal means engaged with the disk web, and wherein engagement of the locating means with the rotor disk bore axially locates the sideplate assembly such that the third seal means and the disk web are in axially interfering engagement, the interfering engagement urging the sideplate web away from the disk web to thereby produce a sealing force between the third seal means and the disk web.

9. The gas turbine engine according to claim 3, wherein the sideplate web includes third seal means engaged with the disk web, and wherein engagement of the locating means with the rotor disk bore axially locates the sideplate assembly such that the third seal means and the disk web are in axially interfering engagement, the interfering engagement urging the sideplate web away from the disk web to thereby produce a sealing force between the third seal means and the disk web.

10. The gas turbine engine according to claim 4, wherein the sideplate web includes third seal means engaged with the disk web, and wherein engagement of the locating means with the rotor disk bore axially locates the sideplate assembly such that the third seal means and the disk web are in axially interfering engagement, the interfering engagement urging the sideplate web away from the disk web to thereby produce a sealing force between the third seal means and the disk web.

11. A rotor assembly for a gas turbine engine having a longitudinal axis and an axially disposed flow path defining a passage for working fluid, the rotor assembly including a rotor disk and a sideplate assembly, the rotor disk having a rotor self-sustaining radius and including a rotor disk bore disposed radially within the rotor self-sustaining radius and a rotor web disposed radially outward of the rotor self-sustaining radius, the sideplate assembly being free standing, positioned axially adjacent to the rotor disk and defining a disk cavity therebetween, the sideplate assembly including a sideplate disk having a sideplate self-sustaining radius, a sideplate bore disposed radially within the sideplate self-sustaining radius, and a sideplate web disposed radially outward of the sideplate self-sustaining radius, locating means disposed on the sideplate bore and engaged with the rotor disk bore, the sideplate blocking the passage of working fluid into the disk cavity such that engagement between working fluid and the rotor web is blocked, and wherein the sideplate assembly is not axially or radially supported by the disk web.

12. The rotor assembly according to claim 11, further including a source of cooling fluid and wherein the sideplate disk further includes an aperture adapted to permit fluid communication between the source of cooling fluid and the cavity.

13. The rotor assembly according to claim 12, wherein the source of cooling fluid is a tangential onboard injector having an injection axis, wherein the aperture includes an axially directed central axis, and wherein the injection axis and central axis are not radially aligned such that the central axis is radially outward of the injection axis.

14. The rotor assembly according to claim 11, further including seal means, the seal means including a first rotating seal disposed on the sideplate bore and a second rotating seal disposed on the sideplate web, the first rotating seal and second rotating seal defining a second cavity, the second cavity in fluid communication with the source of cooling fluid and with the disk cavity.

15. The rotor assembly according to claim 12, further including seal means, the seal means including a first rotating seal disposed on the sideplate bore and a second rotating seal disposed on the sideplate web, the first rotating seal and second rotating seal defining a second cavity, the second cavity in fluid communication with the source of cooling fluid and with the disk cavity.

16. The rotor assembly according to claim 13, further including seal means, the seal means including a first rotating seal disposed on the sideplate bore and a second rotating seal disposed on the sideplate web, the first rotating seal and second rotating seal defining a second cavity, the second cavity in fluid communication with the source of cooling fluid and with the disk cavity.

17. The rotor assembly according to claim 11, wherein the sideplate web includes third seal means engaged with the disk web, and wherein engagement of the locating means with the rotor disk bore axially locates the sideplate assembly such that the third seal means and the disk web are in axially interfering engagement, the interfering engagement urging the sideplate web away from the disk web to thereby produce a sealing force between the third seal means and the disk web.

18. The rotor assembly according to claim 12, wherein the sideplate web includes third seal means engaged with the disk web, and wherein engagement of the locating means with the rotor disk bore axially locates the sideplate assembly such that the third seal means and the disk web are in axially interfering engagement, the interfering engagement urging the sideplate web away from the disk web to thereby produce a sealing force between the third seal means and the disk web.

19. The rotor assembly according to claim 13, wherein the sideplate web includes third seal means engaged with the disk web, and wherein engagement of the locating means with the rotor disk bore axially locates the sideplate assembly such that the third seal means and the disk web are in axially interfering engagement, the interfering engagement urging the sideplate web away from the disk web to thereby produce a sealing force between the third seal means and the disk web.

20. The rotor assembly according to claim 14, wherein the sideplate web includes third seal means engaged with the disk web, and wherein engagement of the locating means with the rotor disk bore axially locates the sideplate assembly such that the third seal means and the disk web are in axially interfering engagement, the interfering engagement urging the sideplate web away from the disk web to thereby produce a sealing force between the third seal means and the disk web.

* * * * *